US005674803A

United States Patent [19]

Delaney

[11] Patent Number: 5,674,803

[45] Date of Patent: Oct. 7, 1997

[54] HEAT-PRINTABLE MATERIAL HAVING THERMALLY PRINTED INDICIA

[75] Inventor: Sean Michael Delaney, Farmington, N.Y.

[73] Assignee: Labelon Corporation, Canandaigua, N.Y.

[21] Appl. No.: 123,808

[22] Filed: Sep. 20, 1993

[51] Int. Cl.[6] ..... B41M 5/30

[52] U.S. Cl. ..... 503/206; 427/286; 428/194; 428/211; 503/214

[58] Field of Search ..... 428/194, 211; 503/206, 214; 427/286

[56] References Cited

U.S. PATENT DOCUMENTS 4,851,383 7/1989 Fickenscher et al. ..... 503/200

FOREIGN PATENT DOCUMENTS 57-74194 5/1982 Japan ..... 503/206

OTHER PUBLICATIONS

Component list for Goebel Practica H4 Slitter, dated Aug. 9, 1978, with attached drawing.

Component list for Dusenbery Model 614AA Shear Cut Slitter and Rewinder, dated May 22, 1973, with attached drawing.

Component list for Dusenbery Model 614AB Semi-automatic Slitter and Rewinder, dated Jan. 19, 1988.

*Primary Examiner*—Bruce H. Hess

*Attorney, Agent, or Firm*—Nixon, Hargrave, Devans & Doyle

[57] ABSTRACT

Rolls of heat-printable material have heat-printed end warning stripes for several feet along the edges of the material at the end of the roll. The stripes are formed by pressing a heated roller into contact with the material as it is slit and wound on take-up cores during manufacture.

7 Claims, 4 Drawing Sheets

HEAT-PRINTABLE MATERIAL HAVING THERMALLY PRINTED INDICIA

FIELD OF THE INVENTION

This invention relates generally to facsimile output material, and more particularly to heat-printable facsimile material, and most particularly to rolls of said material having thermally printed indicia as an end-of-roll warning. This invention relates also to apparatus and method for producing said rolls.

BACKGROUND OF THE INVENTION

Devices such as facsimile (FAX) machines and priming calculators, for example, often employ heat-printable paper as the hard copy medium for their output. The heat-printable paper is typically supplied to the ultimate user in the form of finished rolls which are cut into sheets or pages by a FAX machine as messages are transcribed. A roll of paper may be long enough to yield one hundred or more pages. Because the supply roll is hidden from view in these devices, however, the user sees only that portion of the paper that is being printed as it passes through the device. The amount of paper remaining on the roll is unknown to the user. To alert the user that the end of roll is near, typically, the surface along one edge of the last 8 to 10 feet of the rolled paper supply is marked with an ink or alcohol stripe.

In the manufacture of finished rolls of heat-printable paper, a slitter machine converts a wide bulk roll of sensitized web material into a plurality of shorter and narrower end-user rolls. Between a bulk roll input and the finished roll output of the slitter machine, the heat-printable paper encounters a curing apparatus for slitting the wide web into a plurality of narrower webs, each web having a preselected width, e.g., 8½ inches. A slitter can also include a marking apparatus for marking each narrower web, either before or after slitting, with an ink or alcohol stripe along an edge of the first few feet of paper rolled onto each finished roll core. This footage becomes the terminal end of each finished roll of the sensitized paper. The ink or alcohol marking can be wound either against the core ("in") or opposite the core ("out").

The current practice of printing ink or alcohol end warning stripes has serious shortcomings resulting in high manufacturing waste and a less than optimum product. First, ink and alcohol-based end-warning stripes often have poor resolution and contrast because the ink making rollers tend to dry out between uses. Thus, the end user must be particularly watchful for the warning stripes, else they go unnoticed allowing the paper supply to run out. Second, mechanical vibrations in the slitter can cause the alcohol or ink in the trough to splatter onto the paper, resulting in an unmarketable end product and increased manufacturing cost. Marking fluid can also easily splatter on the machine operator or spill onto the floor, creating biohazards and unsafe work areas. Third, the ink solvents as they evaporate must be vented, creating an environmental hazard, or recovered at an increase in cost. Fourth, additional apparatus and/or manpower is required to maintain the necessary level of marking liquid in the fluid trough and to service external components such as marking substances, liquid holding trays, and ink pads. Fifth, ink is an inherently messy substance and requires some amount of drying time after it is applied to the paper and prior to rewinding on the end-user core, otherwise it will smear or transfer. There is thus a need for an end-use product, and the apparatus, methods, and materials to produce that product, which do not suffer the disadvantages associated with ink or alcohol based end-of-roll marking.

The present invention provides finished rolls of heat-printable paper or other web material that have selectively located, thermally printed stripes or other indicia on a surface of the paper. The invention can also provide individual finished rolls of such paper having thermally printed indicia which contain a readable message in any language, or consisting of any arbitrary or fanciful design. Further, the invention includes apparatus for selectively thermally printing indicia on heat-printable coated paper or other heat-printable web material. The present invention also includes a method for selectively thermally printing indicia on the surface of a heat-printable web with improved safety, efficiency, versatility, and better economy and superior product than ink or alcohol methods for printing indicia on such web material.

SUMMARY OF THE INVENTION

The invention comprises a heat-printable web material, which comprises a roll of said material wound on a core, an end portion of said material which forms the innermost laps of said roll having heat-developed visible warning indicia imprinted thereon.

The invention further comprises an apparatus for cutting, imprinting, and winding a roll of heat-printable material having a thermally-sensitive indicia-forming surface onto one or more cores, each supporting an individual finished roll, in which each finished roll includes a region of heat-printed surface. The apparatus comprises an unwinder for a supply roll located at an input of the apparatus; a power-driven winder for supporting one or more finished rolls at an output of the apparatus; a slitter assembly disposed between the supply roll and finished rolls for slitting the web as it travels between the unwinder and the winder of the apparatus; and one or more controllably heatable print heads rotatably mounted between the unwinder and the winder wherein the printheads are selectively engageable with the heat-printable surface of the web. Alternatively, the invention can comprise means mounted in the slitter machine for heating the heat-printable surface of the web with, for instance, electromagnetic radiation.

The web material itself can comprise paper; polymers, such as poly(ethylene terephthalate), polysulfone, polyvinyl chloride, polystyrene, and cellulose acetate; or fabric.

The invention further comprises a method for thermally printing a selected portion of a roll of heat-printable web during manufacture of said web comprising the steps of providing a supply roll of the web in an apparatus for slitting the supply roll and for winding the subdivided portions into one or more finished rolls; and selectively heating the heat-printable surface of the web to a temperature sufficient to activate said surface as the moving web passes from the input to the output of the apparatus.

DETAILED DESCRIPTION OF THE INVENTION

The invention comprises an apparatus for unwinding a supply roll of heat-printable paper or other web material;

conveying the unwound web; imprinting indicia on the unwound web selectively by means of one or more heated printwheels; slitting the selectively-printed unwound web into a plurality of predetermined widths; and winding the slit web on end-user cores to produce a plurality of finished output rolls each having a heat-printed end-of-roll warning stripe or other heat-printed indicia thereon. The invention, however, is not limited to printing a plain stripe on a web. Any selected message or design of limited content, in any language, over any selected location and for any distance can be printed on the web. Furthermore, the web itself may comprise paper, plastic, or other materials capable of being surface coated with a heat sensitive, imaging or printable composition.

Figure 1:
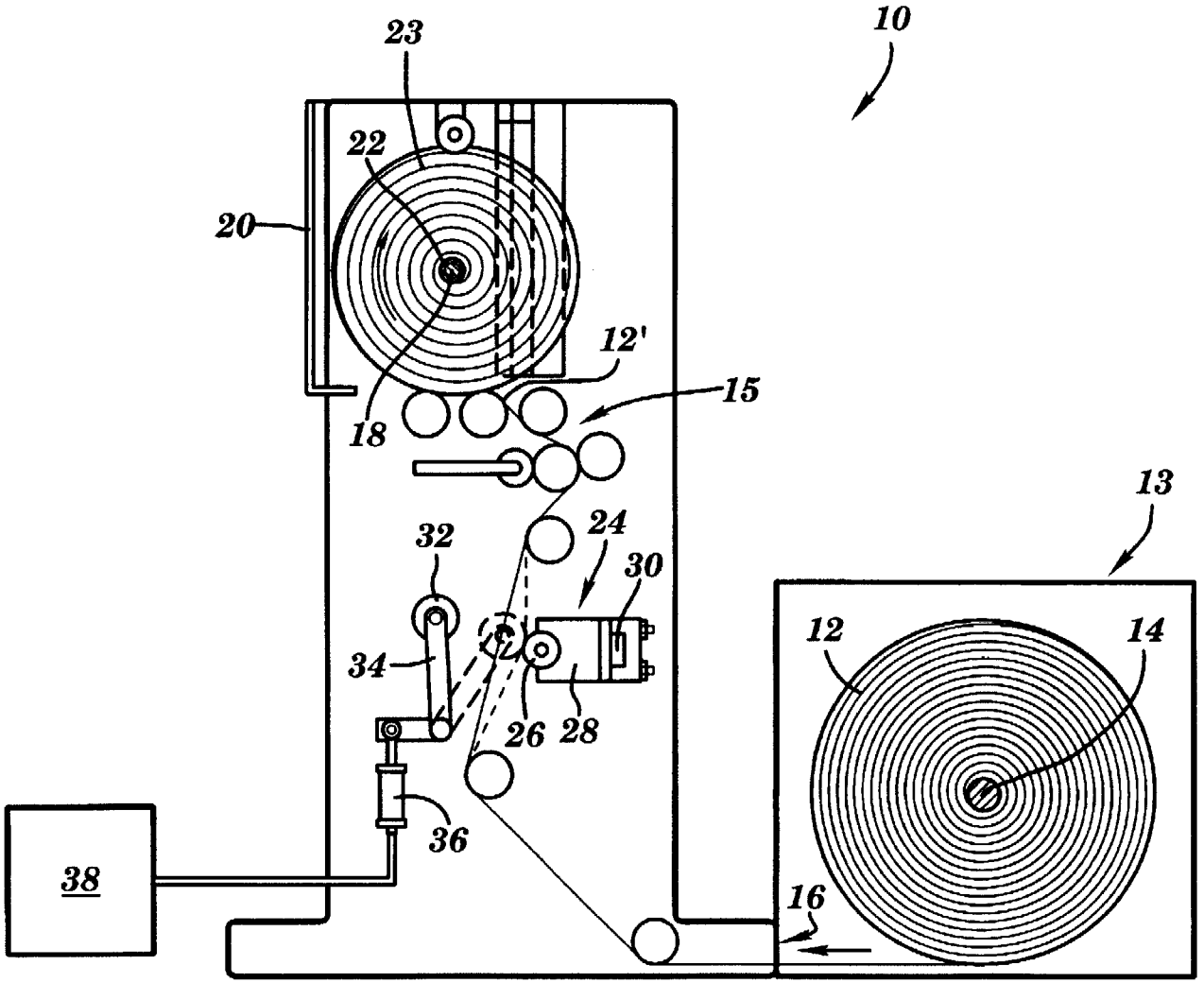
FIG. 1 is a schematic cross-section of an apparatus of the invention.

Referring to the drawings in which like reference numbers represent like components throughout the various views, FIG. 1 shows a schematic cross-section of an apparatus of the invention, comprising slitter machine 10 for thermal FAX paper or thermal printing calculator paper which is conventional except for modification as described hereafter to permit heat-printing on heat-printable paper. At unwinder 13, bulk supply support shaft 14 supports a bulk supply roll 11 of heat-printable marked paper 12 at input end 16 of slitter machine 10. The moving web of paper 12 is slit into a plurality of narrower webs 12' by conventional slitter assembly 15. Power driven winder bar 18 is disposed at output end 20 of slitter machine 10. One or more individual end-user cores 22 are removably supported on winder bar 18 to receive the slit web 12'. The conventional ink or alcohol end-warning stripe marking apparatus is replaced by print head assembly 24 comprising one or more heatable print wheels 26 for selectively applying heat, each rotatably mounted on an axle 31 and a base 28 having a controllable heating element 27 (not shown), bases 28 being slidably, removably, mounted on mounting bar 30. Preferably, each printwheel 26 is a disc section cut from brass bar stock of appropriate diameter wherein the perimeter has been machined into relief representation of the indicium to be printed on paper 12. Opposed to printwheels 26 is pressure roller 32, unwound paper 12 passing therebetween. Pressure roller 32 is mounted on rotatable actuating arm 34 which is responsive to hydraulic or pneumatic cylinder 36 to either engage printwheels 26 with paper 12, or position them in a retracted position. A programmable actuator controller 38, such as a linear distance counter, controls the engagement of print head assembly 24 over the selected distance of paper 12 to be printed. Preferably, the engagement is programmed to occur along the two to fifteen running feet of paper 12 first wound around end-user cores 22 and most preferably along the first eight to twelve running feet of paper 12.

In operation, printwheels 26 and their respective bases 28 are fixed at designated positions along mounting bar 30, the positions being selected to print indicia at the appropriate widthwise location in finished rolls 23. The non-critical temperature of controllable heating elements 27 is set at about 225° F., heating printwheel bases 28 and thereby heating printwheels 26 to a temperature sufficient to form indicia on heat-printable paper 12. Bulk supply roll 11 of thermal FAX paper 12 is mounted on supply support shaft 14. The leading edge of web 12 is led through input 16, between heatable printwheels 26 and pressure roller 32 in its retracted position, and through conventional slitter assembly 40 where paper web 12 is split into a plurality of finished width webs 12'. Webs 12' are attached to end-user cores 22, the length of web between printwheels 26 and cores 22 being preferably about two feet or less. The drive of slitter machine 10 is energized and simultaneously pressure roll 32 is driven to its actuated position whereby unwound paper 12 is pressed against heated printwheels 26, causing them to turn synchronously with paper 12, thereby heat-printing the indicia of printwheels 26 on paper 12 at the designated widthwise locations. After passage of a pre-programmed length of paper 12 past printwheels 26, for example eight to twelve feet, pressure roller 32 is retracted and paper 12 assumes a conveyance path not in contact with printwheels 26. When the desired length of slit paper 12' has been wound on end-user cores 22, slit paper 12' is severed, finished rolls 23 are removed from slitter machine 10, a new set of empty end-user cores 22 is installed, and the process is repeated.

Figure 2:
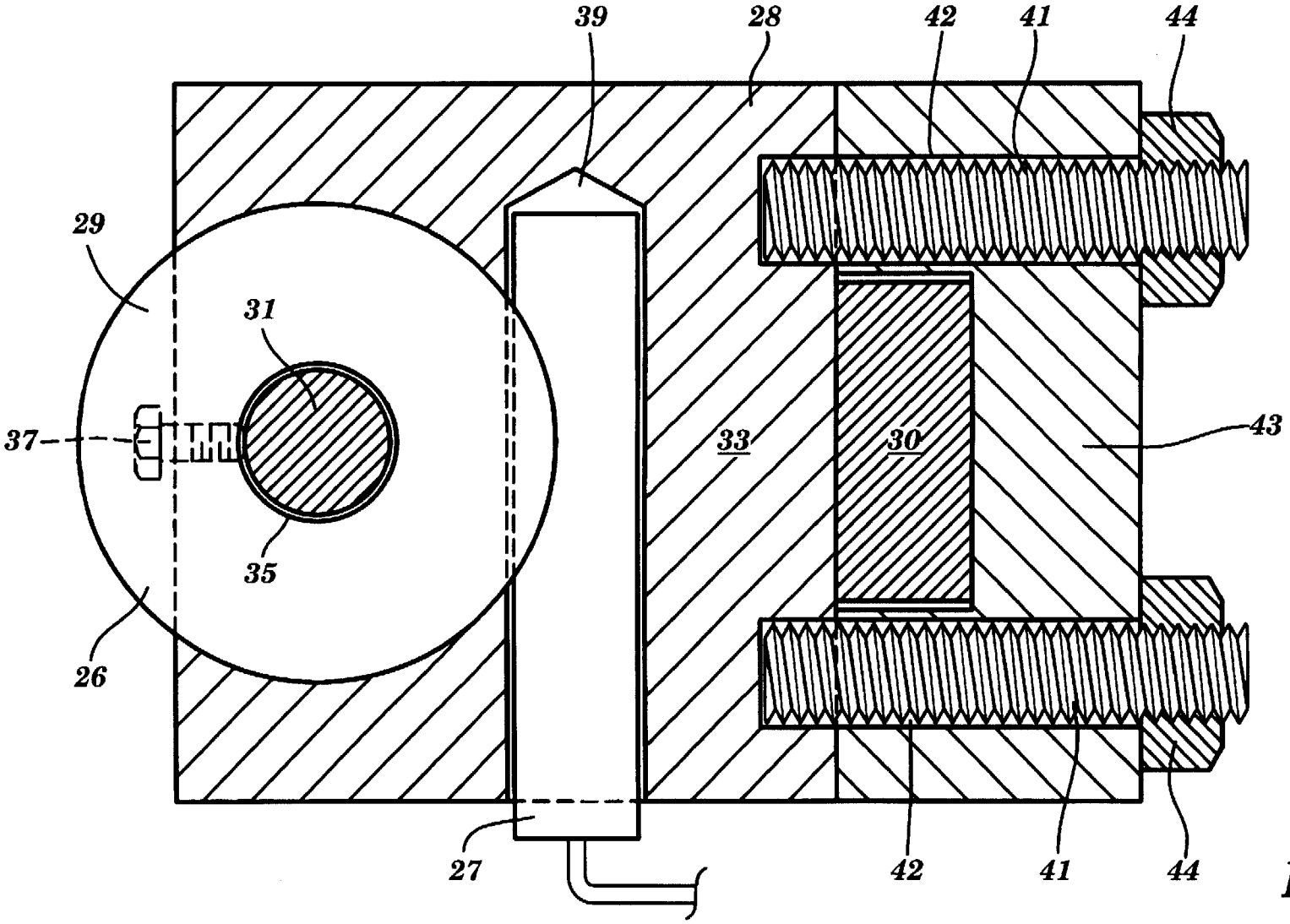
FIG. 2 is a more-detailed cross-section of the print head assembly of FIG. 1.

FIG. 2 shows print head assembly 24 in greater detail. Assembly 24 preferably comprises one or more heatable printwheels 26 that roll over the heat sensitive surface of paper 12 when pressure roller 32 is in its actuated position, as paper 12 travels through the slitter machine web path. Printwheel 26 itself preferably comprises center-bored disc 29 of a thermally conductive material having a raised perimeter section representing the text of any indicia to be printed on paper 12. Each printwheel 26 is rotatably mounted on the end of an axle 31 disposed in the center bore of printwheel 26. Printwheel 26 is formed from any easily machined, thermally conductive material. Printwheel blank disks can be cut from solid brass bar stock of the appropriate diameter, for example, and the perimeter machined to form the desired indicia.

The print head assembly further comprises printwheel mounting base 28 including first portion 33 having first bore 35 and set screw 37 for replaceably retaining printwheel axle 31. Mounting base first portion 33 has second bore 39 for receiving a controllable heating element 27 that is connected to a temperature controller (not shown). First portion 33 further contains one or more threaded rods 41 which project to slide through holes 42 in second, attachable, mounting base portion 43 permitting mounting base portion 43 to be slidably, removably, secured to mounting bar 30 when first and second mounting sections 33 and 43 are joined together and secured with nuts 44 on threaded rods 41. This simple assembly allows the slitter machine operator to locate printwheels 26 anywhere across the paper path such that they will engage paper 12 along at least one running edge of each ultimate slit web 12'. Printwheel mounting base 28 comprises a thermally conductive material such as aluminum, for example.

Figure 3:
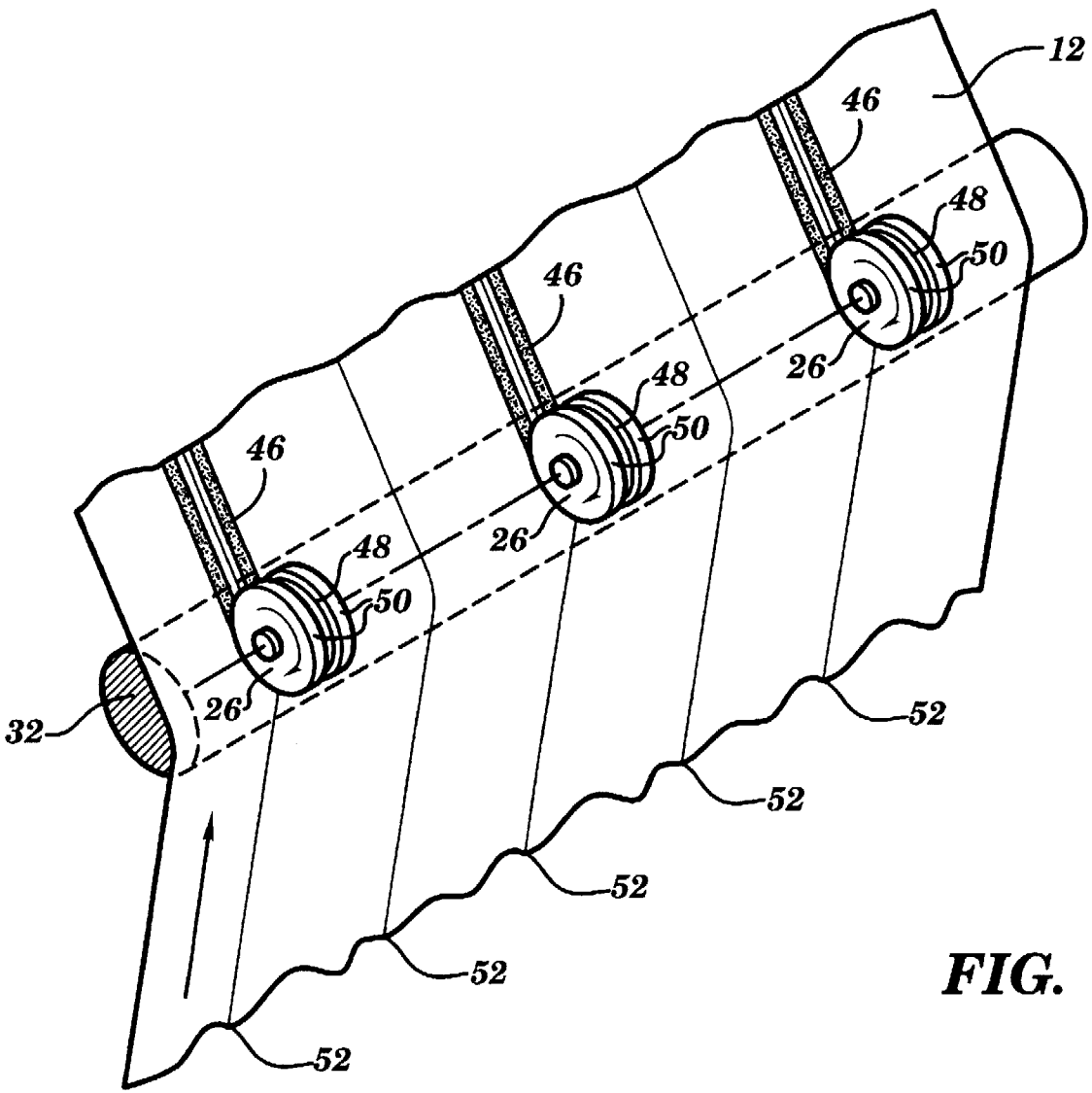
FIG. 3 is a perspective view of heat-printable web of the invention being thermally printed by simplified apparatus of FIG. 1.

FIG. 3 is an isometric view of a portion of the apparatus of FIG. 1, showing heat-printable paper 12 being pressed by pressure roller 32 against heated printwheels 26, whereby printed indicia 46 are formed. For clarity of presentation, all other print head assembly components shown in FIG. 2 are omitted from FIG. 3.

FIG. 3 shows an efficient means of providing slit web 12', requiring only n/2 printwheels 26 where n represents the number of slit webs 12'. The printwheels 26 are constructed from double-thickness disks and comprise a centrally-located circumferential groove 48 with indicia patterns on each perimeter printing surface 50 adjacent groove 48. Each printwheel is positioned laterally in print head assembly 24 and secured by set screw 37, such that groove 48 is precisely aligned longitudinally with alternating rotary knives (not shown) of slitter assembly 15. The eventual slitting locations across paper 12 are shown as lines 52. Finished rolls 23 will thus exhibit heat-printed indicia on the left and right edges of alternating finished rolls, respectively.

Figure 4:
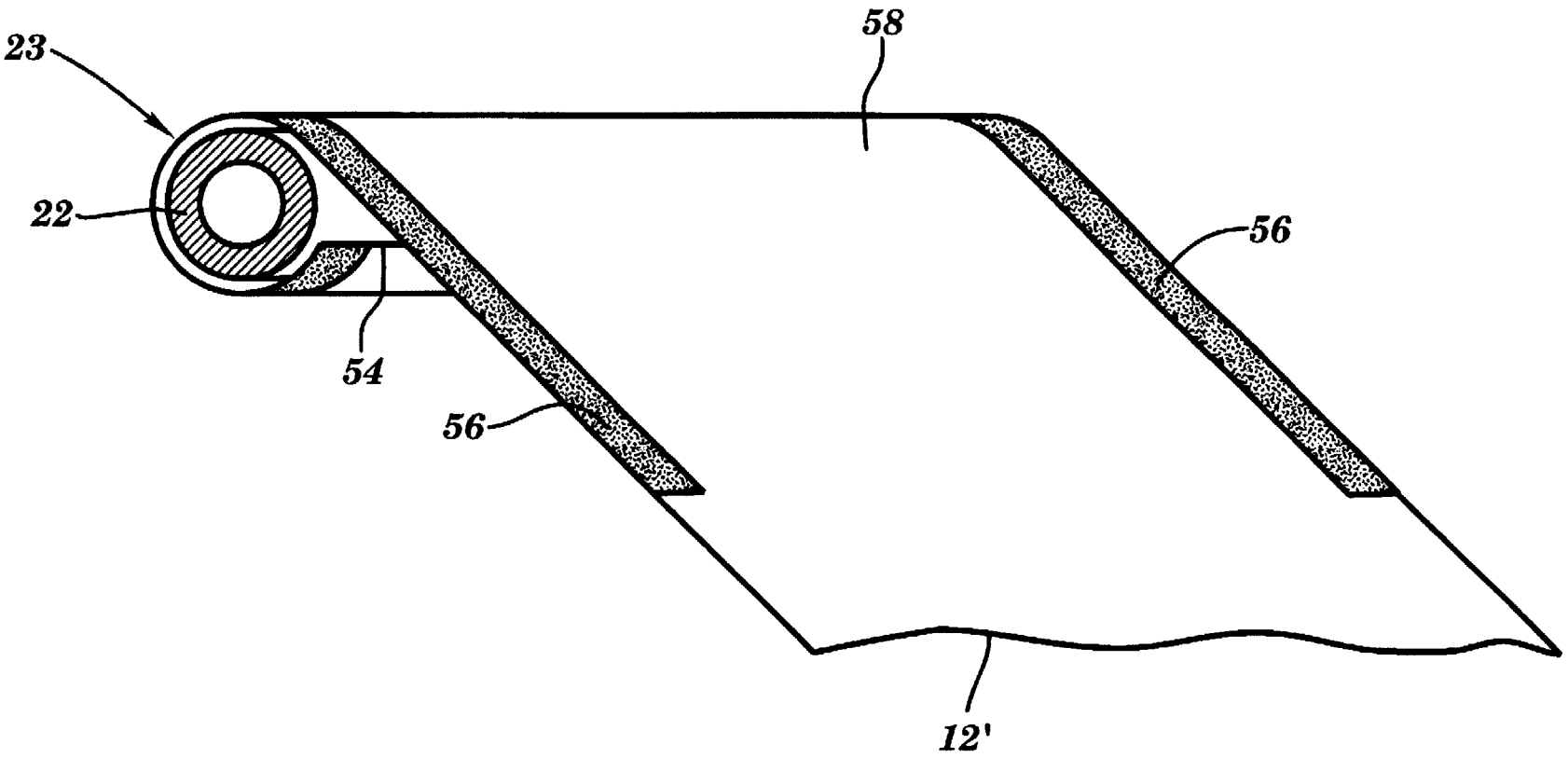
FIG. 4 is a perspective view of a finished roll of the heat-printable web of the invention showing end-of-roll warning indicia along both edges.

FIG. 4 shows a perspective view of finished roll 23 as it would appear when unwound to near its inner end 54 at core 22. Thermally printed end-of-roll warning strips 56 are shown along each edge of thermally-printable surface 58 of slit web 12'.

The invention has been described in detail with particular reference to prepared embodiments thereof, but it will be understood that variations and modifications can be effected within the spirit and scope of the invention.

What is claimed is:

1. A heat-printable web material comprising a roll of heat-sensitive recording material wound on a core, with only an end portion of said heat-sensitive recording material being selectively heat-developed to provide visible indicia which serve as a warning that the heat-sensitive recording material will soon be exhausted from the roll.

2. A web material of claim 1 wherein said heat-sensitive recording material is thermal FAX paper.

3. A web material of claim 2 wherein said indicia comprise one or more heat-printed stripes on one or more longitudinal edges of said paper.

4. A web material of claim 3 wherein said stripes are thermally printed on the edges of the roll of said heat-sensitive recording material for a distance up to about twelve feet from the inner end thereof.

5. A web material of claim 1 wherein said indicia comprise heat-printed language.

6. A web material of claim 1 wherein said heat-sensitive recording material comprises a paper substrate.

7. A web material of claim 1 wherein said heat-sensitive recording material further comprises a polymer selected from the group consisting of poly(ethylene terephthalate), polysulfone, polyvinyl chloride, polystyrene, and cellulose acetate.

* * * * *